United States Patent [19]

Edmond et al.

[11] 4,030,345

[45] June 21, 1977

[54] BOREHOLE PRESSURE CELL

[75] Inventors: Tibor O. Edmond; H. Douglas Dahl, both of Ponca City, Okla.

[73] Assignee: Continental Oil Company, Ponca City, Okla.

[22] Filed: Aug. 13, 1976

[21] Appl. No.: 714,065

[52] U.S. Cl. ..... 73/88 E

[51] Int. Cl.[2] ..... E21B 49/00

[58] Field of Search ..... 73/84, 88 E, 152, 88 R, 73/151

[56] References Cited

UNITED STATES PATENTS

| | | | |
|---|---|---|---|
| 3,466,926 | 9/1969 | Ruppeneit et al. | 73/84 X |
| 3,987,669 | 10/1976 | Daneshy | 73/88 E X |

OTHER PUBLICATIONS

Lord, A. E. et al., Acoustic Emission. . . Capacity from Materials Evaluation, May 1976, pp. 103–108.

*Primary Examiner*—Jerry W. Myracle
*Attorney, Agent, or Firm*—Richard W. Collins

[57] ABSTRACT

A device and method for determining strength properties of a subterranean formation. The device is insertable into a borehole formed in the formation, and includes a pair of inflatable semi-cylindrical members mounted on a shaft. The inflatable members when pressurized exert radial force in all directions except along the plane between the members, with the result that a higher parting force is exerted on the formation perpendicular to the plane between the members than across any other plane through the axis of the device.

7 Claims, 8 Drawing Figures

BOREHOLE PRESSURE CELL

BACKGROUND OF THE INVENTION

1. Field of the Invention

This invention relates to a device and method for determining in situ stresses and/or strength characteristics of a subterranean formation. More particularly, the invention relates to a device for insertion in a borehole extending into a formation, which device when pressurized exerts force radially against the borehole wall in all directions except along one plane dividing the device longitudinally.

There are many situations, such as during mining of coal or other mineral from a subterranean formation, where it is desirable to know the existing in situ stresses and/or the strength characteristics of a particular formation. Such knowledge is useful in planning the developement of the formation, and particularly as to the safety of the operation.

2. Description of the Prior Art

There are many procedures of varying degrees of usefulness which have been previously utilized in attempts to analyze the stresses and strength characteristics of subterranean formations. One method of determining the strength of a formation has been to seal a portion of a borehole with packers and then pressurize the sealed section. The formation fracture pressure can be determined in this manner, but this only gives information regarding the weakest direction. It is desirable to have information regarding stresses and strength in a plurality of directions and at a plurality of locations in order to analyze a formation by non-destructive methods. Such information is useful in techniques such as finite element analysis of force distribution within a formation.

The present invention makes possible a non-destructive "microseismic" method of formation analysis because of its capability for providing information in a plurality of directions which reflects the forces acting on the formation at a given location.

SUMMARY OF THE INVENTION

According to the present invention, a device is provided which is easily inserted into a borehole extending into a subterranean formation, which device when pressurized exerts uniform radial forces agains the borehole wall in all direction except along a particular plane extending longitudinally through the device. As a result, a parting force is exerted on the formation through that particular plane which is higher than the parting force exerted on any other plane through the axis of the device. The formation typically develops stress microcracks well before failure pressure is exerted on it, and by using a sound pickup with device which detects microcrack occurrence the strength characteristics of a formation can be determined for a given plane through the formation. The formation strength through several planes at a particular location in the formation can be determined by this invention since it is not necessary to fracture the formation to obtain a measurement through a particular plane. Such information is useful for establishing a safe mining program.

The device according to the invention includes a pair of inflatable semi-cylindrical members mounted on a shaft having a fluid passage for pressurizing the inflatable members. The device is inserted while uninflated and then when in position it is inflated by fluid pressure such that it contracts the borehole wall and exerts pressure on the wall. Because of the unique structure of the device, no pressure is exerted along one particular plane, and as a result the formation strength through that plane can be determined.

DESCRIPTION OF THE PREFERRED EMBODIMENTS

The most preferred embodiment of the invention will now be described by reference to the accompanying drawings illustrating same.

Figure 2:
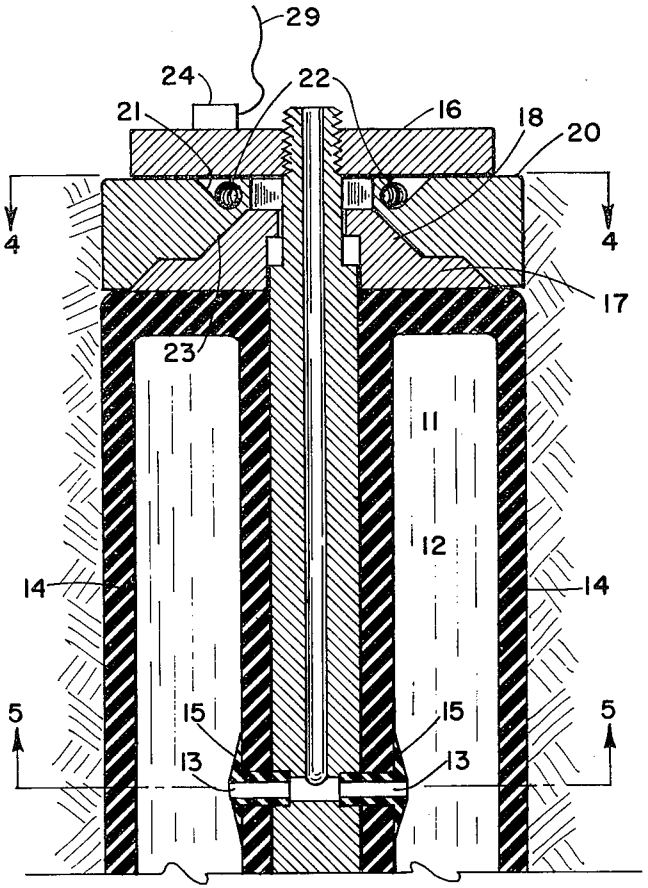
FIG. 2 is a cross-sectional view taken along the line 2—2 of FIG. 1 showing the interior of the upper portion of the device in the pressurized condition.
Figure 1:
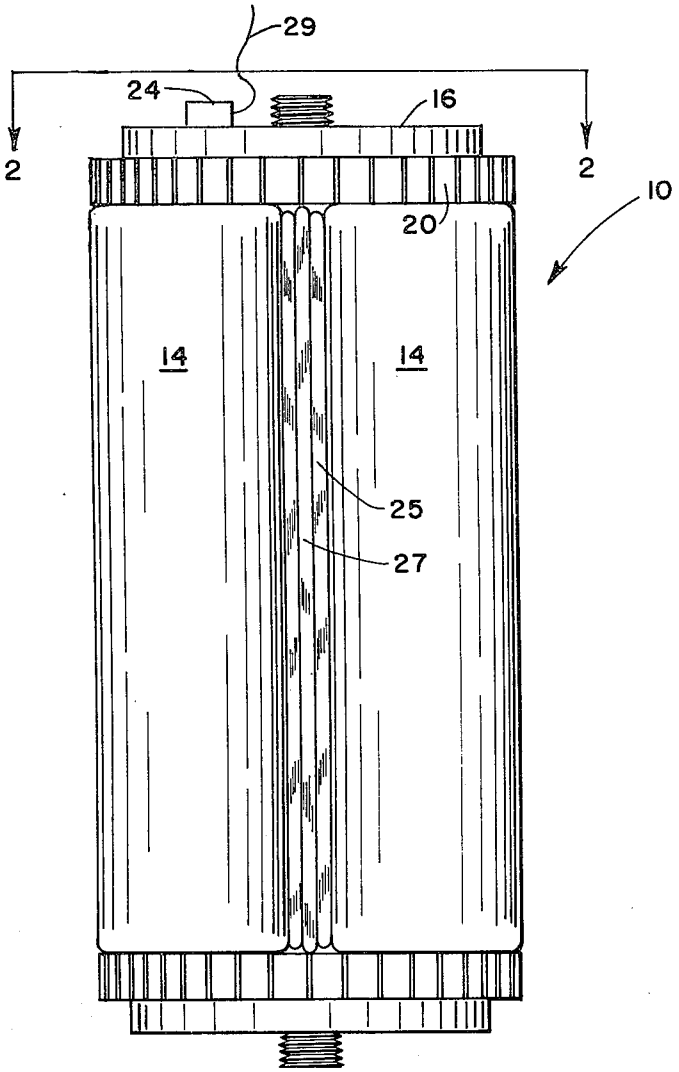
FIG. 1 is a side elevational view showing a preferred form of the device.
Figure 3:
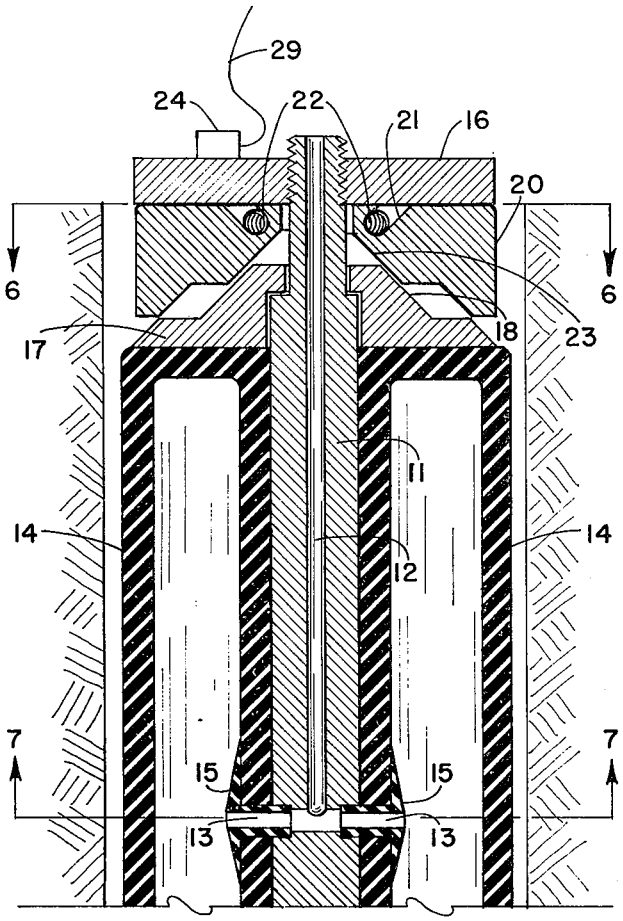
FIG. 3 is a view similar to FIG. 2 but showing the device in the unpressurized condition.

The overall device 10 is illustrated generally in FIG. 1, and as best seen in FIGS. 2 and 3 includes a central shaft member 11 having a fluid passage 12 extending from the top end of the device to an intermediate portion of the shaft. Fluid passage 12 intersects a transverse fluid passage through shaft 11 constituting a pair of outlets 13.

A pair of elastomeric semi-cylindrical members 14 are bonded to shaft 11 and plate 25 (FIGS. 5 and 7) and positioned so as to form a generally cylindrical structure. Each semi-cylindrical member 14 includes an opening in register with an outlet 13 such that fluid transmitted down fluid passage 12 flows into semi-cylindrical members 14. An insert 15 extends from the interior of each member 14 into each outlet 13 to help position the opening in member 14 over outlet 13. The member 14 may be formed of any natural synthetic tough elastomeric material. Butyl rubber is a particularly good material for these members.

Figure 4:
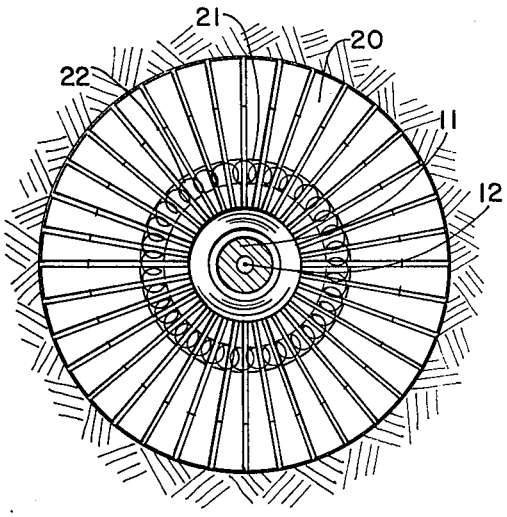
FIG. 4 is a top plan view, partly in cross-section, taken along the line 4—4 of FIG. 2 with the device in the pressurized condition.

The top end of device 10 includes a fixed support plate 16 attached to shaft 11 (FIG. 2). A floating support plate 17 (FIGS. 2 and 3) movable axially along shaft 11 is positioned just above the upper ends of members 14. Floating support plate 17 has an upper angled surface 18 (FIG. 3), the purpose of which will be described later. Located between fixed support plate 16 and floating support plate 17 is a segmented radially expandable disc unit constructed of a plurability of segments 20 as shown in FIGS. 1, 4 and 6.

Figure 6:
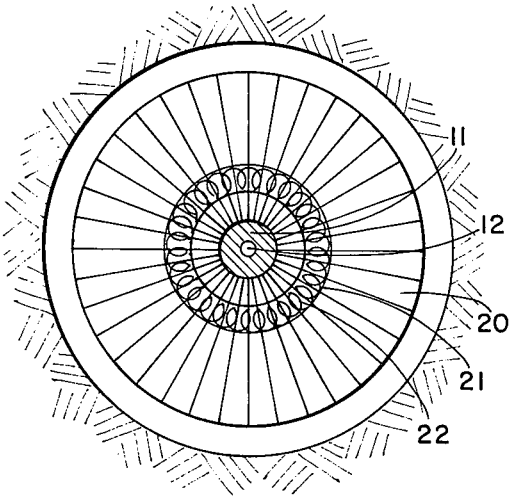
FIG. 6 is a top plan view, partly in cross-section, taken along the line 6—6 of FIG. 3 with the device in the unpressurized condition.

Each segment 20 forms a part of a circle in plan view, and the inner edge of each segment 20 is shaped to fit about shaft 11 when the device is in the unpressurized condition as shown in FIG. 6. Near the inner end of each segment 20 is a spring-retaining groove 21, and a spring 22 or elastic ring in the groove 21 of a series of segments 20 operates to bias the segments against shaft 11. Each segment 20 has an angled surface 23 (FIG. 3) which matches angled surface 18 on floating support plate 17. It will be apparent that upon movement of floating support plate 17 toward the expandable disc formed of segments 20 that the angled surface 18 of plate 17 will act on angled surfaces 23 on segments 20 and move the segments 20 radially outward from shaft 11. As is clear from FIG. 2, the outward movement of segments 20 is limited. Upon movement of floating plate 17 away from the disc unit, spring 22 acts to return segments 20 to the original position shown in FIGS. 3 and 6.

A microphone 24 including an electrical lead 29 is shown mounted on upper support plate 16 for purposes to be described later.

The lower end of device 10 includes substantially indentical parts as described above for the upper end, except that no microphone is associated therewith.

Figure 5:
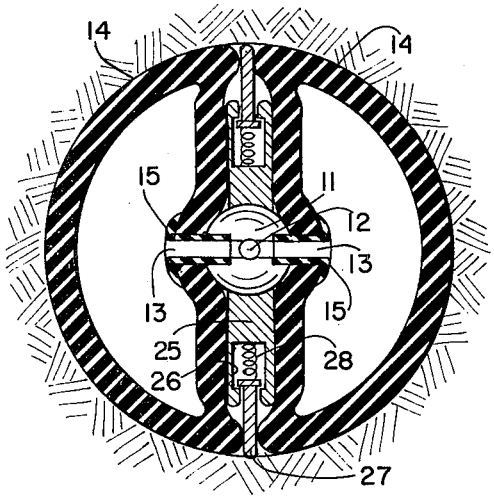
FIG. 5 is a cross-sectional view of the device of FIG. 1, taken along the line 5—5 of FIG. 2 with the device in the pressurized condition.
Figure 7:
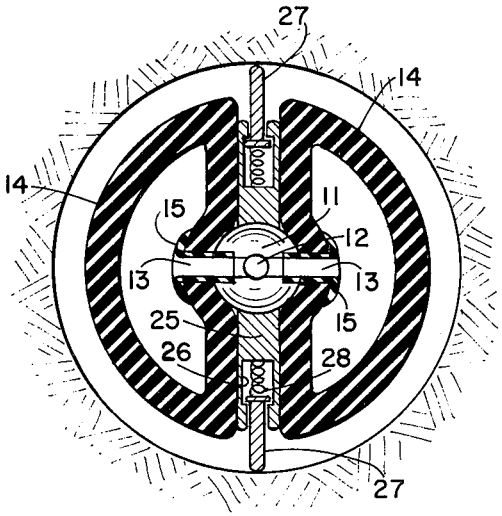
FIG. 7 is a view similar to FIG. 5 but with the device in the unpressurized condition.
Figure 8:
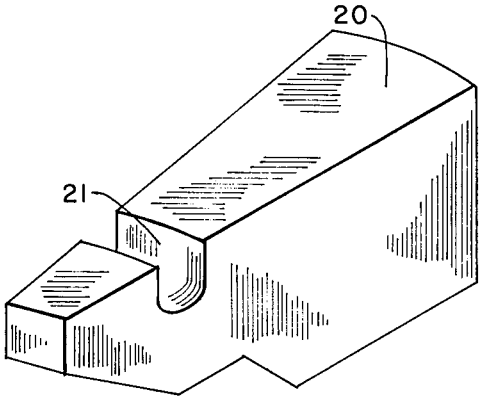
FIG. 8 is a perspective view of a segment forming a part of the device.

Referring now to FIGS. 5 and 7, shaft 11 includes flat plate members 25 extending outwardly therefrom and constituting separating means for keeping the flat surfaces of inflatable members 14 out of contact with each other. The outer edge of each plate member 25 has a slot 26 formed therein, and a strip 27 is positioned in each slot 26 and biased outwardly by springs 28 and retained by a shoulder formed near the outer limit of slot 26.

The operation of the device 10 will now be described for a typical project of determining the strength characteristics of a subterranean formation. First, a borehole having a diameter slightly larger than that of fixed support plate 16 of the device 10 is drilled into a subterranean formation. The device 10 is then lowered into the borehole by pipe joints (not shown) connected to shaft 11, care being taken to maintain a known orientation of device 10 within the borehole.

When the device 10 is at the desired depth, fluid is introduced through passage 12 into members 14. Members 14 expand slightly in response to the fluid pressure, and contact the wall of the borehole. Continued injection to fluid into members 14 forces the ends of members 14 outwardly against floating support plates 17, which in turn move outwardly against segments 20 of the disc units, causing segments 20 to move slightly outwardly by the camming action of surface 18 against surface 23. When segments 20 have moved to the full outward position, their outer surfaces are against or very near the wall of the borehole as shown in FIGS. 2 and 4, such that upon increasing the pressure in members 14 the ends thereof cannot bulge out beyond fixed support plates 16. Thus, it will be seen that device 10 can be built with a diameter smaller than the diameter of the borehole in which it is to be used, enabling easy insertion of the device in the borehole. At the same time, expandable disc units formed of segments 20 between fixed support plates 16 and floating plates 17 can extend outwardly to fill the gap between the fixed support plates and the borehole wall upon inflation of members 14, thereby preventing bulging out and bursting of the members 14 when they are subjected to high pressures.

When the expandable disc units are in the enlarged or outermost position, fluid pressure in members 14 is increased until microcracks begin to form in the formation along the plane between the inflatable members 14. This might require a pressure in members 14 of several hundred kilograms per square centimeter. As the microcracks begin to form, typically at about half the pressure required to fracture the formation, the microphone 24 detects the sound generated and transmits it to the operator. The pressure in members 14 is then released, and springs 22 retract segments 20 away from the borehole to the position shown in FIGS. 3 and 6. The device is then rotated through a desired angle and/or moved longitudinally in the borehole, and the process is repeated until sufficient measurements have been made to enable an analysis of the strength characteristics of the formation.

To retrieve the device 10 from the borehole, the pressure in members 14 is released, allowing segments 20 to retract, and the device is then pulled out. Strips 27 do not significantly retard removal, as they are pushed back into slots 26 by the borehole wall.

The number of segments 20 required for each disc unit is determined by the amount of radial movement expected, the strength of the elastomeric member, and the symmetry of the borehole. More than six are required to provide any improvement, as with six segments the maximum dimension of the gap between segments upon expansion is the same as the dimension between the unexpanded and expanded radii. Preferably from 24 to 48 segments are used, with 36 being a particularly preferred number of segments for each disc unit.

In accordance with an alternative simplified version of the invention (not shown), the floating support plates 17 and segments 20 can be eliminated, and the inflatable members 14 can bear directly on fixed support plates 16. This version generally requires a closer fit between the device and the borehole to prevent bulging of the pressurized inflatable members past the fixed support plates. Likewise, this version can be used without the slot and strip in the separating members.

The foregoing detailed description of the construction and operation of the most preferred embodiment of the device is intended to be illustrative rather than limiting, and it will be apparent to those skilled in the art that numerous modifications and variations could be made without departing from the true scope of the invention, which is defined by the appended claims.

What is claimed is:

1. A device for insertion in a borehole comprising:

a central shaft member having a fluid passage means extending from one end thereof for a part of the length thereof, said shaft having a pair of openings extending from the outer surface thereof to said fluid passage means whereby fluid pumped into the device through said fluid passage means may flow outwardly from said shaft:

fixed support plates at each end of said shaft;

a pair of inflatable semi-cylindrical elastomeric chambers affixed to said shaft and located between said support plates, said elastomeric chambers each having an opening in register with one of said pair of openings in said shaft whereby fluid pressure in said fluid passage means is transmitted to the interiors of said chambers; and separating means extending outwardly from said shaft and adapted to prevent mutual contact of said pair of elastomeric chambers.

2. The device of claim 1 including a plurality of segments disposed between each end of said elastomeric chambers and said fixed support plates and being movable from first to second positions, the perimeter defined by said plurality of segments conforming to the perimeter defined by said support plates when in said first position and the perimeter defined by said plurality of segments extending beyond the perimeter defined by said support plates when in said second position.

3. The device of claim 2 including a floating plate adjacent each end of said elastomeric chambers movable along the longitudinal axis of said central shaft, said floating plate being adapted to force said plurality of segments to said second position upon pressurization of said elastomeric chambers.

4. The device of claim 3 including spring means biasing said segments toward said first position.

5. The device of claim 4 including a microphone mounted thereon for detecting noise generated by pressurizing said device within a borehole in a subterranean formation.

6. The device of claim 5 wherein said separating means includes a pair of diametrically opposed flat members extending from said shaft to the extent of said inflatable chambers when they are uninflated, each of said flat members having a slot formed along its outer edge, and each of said slots has an outwardly biased strip contained therein, said strips when in their outermost position extending to the extent of said chambers when they are inflated.

7. A method of determining strength characteristics of a subterranean formation comprising the steps of:

a. forming a borehole into said formation;

b. applying uniform radial forces outwardly against the wall of said borehole in all directions except along a selected diameter of said borehole, thereby applying a higher parting force on said formation across the axial plane extending through said selected diameter;

c. determining the pressure required to generate microcracks in said formation at said plane, said determination being made by means of a sound pickup device; and d. repeating steps (b) and (c) for at least one other selected diameter.

* * * * *